US005659278A

United States Patent [19]

Yanagi et al.

[11] Patent Number: 5,659,278

[45] Date of Patent: Aug. 19, 1997

[54] SUPERCONDUCTING MAGNET DEVICE, MAGNETIZING DEVICE AND METHOD FOR SUPERCONDUCTOR

[75] Inventors: Yousuke Yanagi; Shintaro Harada; Ryohei Yabuno; Tetsuo Oka; Yoshitaka Ito; Tutomu Sakakibara, all of Aichi-ken, Japan

[73] Assignee: Imra Material R&D Co., Ltd., Kariya, Japan

[21] Appl. No.: 369,333

[22] Filed: Jan. 6, 1995

Related U.S. Application Data

[63] Continuation of Ser. No. 159,246, Nov. 30, 1993, abandoned.

[30] Foreign Application Priority Data

Nov. 30, 1992 [JP] Japan ..... 4-355299

[51] Int. Cl.[6] ..... H01F 1/00; H01F 5/00; H01F 6/00

[52] U.S. Cl. ..... 335/216; 335/300; 505/211; 505/879

[58] Field of Search ..... 335/216, 300, 335/296; 310/52; 505/211, 879

[56] References Cited

U.S. PATENT DOCUMENTS

| | | | |
|---|---|---|---|
| 3,842,193 | 10/1974 | Johnson | 174/120 C |
| 4,116,017 | 9/1978 | Oberpriller | 62/62 |
| 4,176,291 | 11/1979 | Rabinowitz | 310/52 |
| 4,341,923 | 7/1982 | Allen | 174/117 R |
| 4,447,797 | 5/1984 | Saunders | 336/205 |
| 4,462,152 | 7/1984 | Okamoto | 29/598 |
| 4,614,999 | 9/1986 | Onodera | 363/28 |
| 4,689,439 | 8/1987 | Sato | 174/15 CA |
| 5,156,003 | 10/1992 | Yoshiro | 62/3.1 |
| 5,254,806 | 10/1993 | Gross | 174/133 R |
| 5,278,137 | 1/1994 | Morita | 505/1 |
| 5,289,150 | 2/1994 | Rabinowitz | 335/216 |

FOREIGN PATENT DOCUMENTS

| | | |
|---|---|---|
| 1-310516 | 12/1989 | Japan . |
| 2-192104 | 7/1990 | Japan . |
| 2-219440 | 9/1990 | Japan . |
| 4-75449 | 3/1992 | Japan . |

*Primary Examiner*—Leo P. Picard
*Assistant Examiner*—Stephen T. Ryan
*Attorney, Agent, or Firm*—Oblon, Spivak, McClelland, Maier & Neustadt, P.C.

[57] ABSTRACT

A superconducting magnet device and magnetizing device for superconductor including a coil provided around the superconductor; a current supply line connected to the coil and a power source and supplying a pulse current from the power source to the coil; and a refrigerant container controlled to a superconducting transition temperature or below, the coil arranged in the refrigerant container, the current supply line provided within refrigerant pipes connecting to the refrigerant container, its applied instrument, and a magnetizing method for superconductor including cooling the interior of the refrigerant container down to the superconducting transition temperature or below; supplying a pulse current to the coil for generating a magnetic field by the coil; and magnetizing the superconductor.

28 Claims, 4 Drawing Sheets

SUPERCONDUCTING MAGNET DEVICE, MAGNETIZING DEVICE AND METHOD FOR SUPERCONDUCTOR

This application is a Continuation of application Ser. No. 08/159,246, filed on Nov. 30, 1993, now abandoned.

BACKGROUNDS OF THE INVENTION

1. Field of the Invention

The present invention relates to a device, (which will be designated as a superconducting magnet device, magnetizing device and method for superconductor thereafter) for allowing a superconductor to capture an magnetic field so as to magnetize the superconductor in such an instrument as utilizes the superconductor as a magnet.

2. Description of the Prior Art

The case of making it possible to use a superconductor as a magnet is limited to only the time when the superconductor is cooled down to a superconducting transition temperature or below to bring the superconductor into its superconducting state. Therefore, it is to be understood that the superconductor, unlike a permanent magnet in general, cannot be magnetized only by applying a magnetic field thereon at a room temperature. For allowing the superconductor to capture the magnetic field so as to magnetize the superconductor (which will be designated as a magnetization thereafter), either of the following two methods will be used.

One of them is a method for magnetizing the superconductor by applying a magnetic field on the superconductor, and then cooling the superconductor down to its own superconducting transition temperature or below while keeping it applied with the magnetic field thereon. (The first method will be designated as FC thereafter).

The other is a method for magnetizing the superconductor by cooling the superconductor down to its own superconducting transition temperature or below and then applying the magnetic field thereon while holding this cooling condition. (The second method will be designated as ZFC thereafter.)

When the superconductor is magnetized, let us consider the ratio of the strength of the magnetic field (which will be designated as a trapped magnetic field thereafter) captured by the superconductor to the strength of the applied magnetic field employed for magnetizing the superconductor. Apparently, when the superconductor is magnetized in an ideal form, the ratio reaches its theoretical maximum value, which is unity in the case of FC and half in the case of ZFC, respectively. The ratio changes depending on the characteristics of the superconductors, but it never becomes a higher value than this theoretical maximum value. Therefore, it is necessary to apply a large applied magnetic field in comparison with that of the target trapped magnetic field when the superconductor is actually magnetized.

Now, in the prior art, either superconducting electromagnets or normal conductive electromagnets were used when superconductors are magnetized. In these devices, they were extremely larger in size than the superconductors to be magnetized, in the case of each having such a capacity as to generate the magnetic field necessary to magnetize the superconductors. So, in the case of integrating a superconductor into an instrument so as to be used as a magnet, the superconductor had to be integrated into the instrument after magnetizing by means of these devices at the outside of the instrument.

On the other hand, in the case of magnetizing permanent magnets, there is employed the magnetic field for generating such a current passing in one direction of a coil for a short period of time. (Such a current, a power source for generating the current and a magnetic field generated when the current is passed through the coil, respectively, will be designated as a pulse current, pulse power source and a pulse magnetic field thereafter.)

When a permanent magnet is integrated into the internal portion of an instrument and the like, particularly, in the case of magnetizing the permanent magnet by the device which employs the pulse power source, a method for integrating the permanent magnet after being magnetized into the internal portion of the instrument, is disclosed in Japanese Pat. Laid Open Pub. No.1-310516, and the other method for altering a material provided in an instrument into a permanent magnet by magnetizing it from the outside of the instrument, is also disclosed in Japanese Pat. Laid Open Pub. No.2-219440. However, since the superconductors require a refrigerant container for cooling the superconductor by refrigerant below their superconducting transition temperature, it is difficult to magnetize the superconductor from the outside of the instrument due to the long distance from the magnetizing york to the superconductor. In the case of magnetizing the superconductor by means of such a method, it becomes impossible to freely design the arrangement of the superconductor within the instrument.

As a magnetizing method of permanent magnets, there is a well-known method for magnetizing the magnetic material within the instrument by winding magnetizing coils around a material to be magnetized and incorporating all of the magnetizing coils in the instrument, and this method is disclosed in Japanese Pat. Laid Open 4-75449. In the case of the superconductors enabling to get a strong magnetic force thereby, however, the applied magnetic field required for magnetizing them becomes far large in comparison with those of permanent magnets. Therefore, the prior art magnetizing coils, which have been employed for magnetizing the permanent magnet in the internal portion of the instrument, cannot adequately magnetize the superconductor since enough magnetic field required for magnetizing the superconductor can not be obtained any more.

Ultimately, in the case of using the superconductor as a magnet by magnetizing the superconductor by means of a pulse magnetizing device of the prior art for permanent magnets, the superconductor had to be magnetized at the outside of the instrument in similarity to the case when magnetized by an electromagnet using a steady-state current. Since the pulse magnetization becomes ZFC which is disadvantageous to magnetization in comparison with FC, such a magnetizing method has hardly been employed in the case of magnetizing the superconductor at the outside of the instrument.

As described above, it is necessary to incorporate the magnetized superconductor in the instrument after magnetizing the superconductor at the outside of the instrument, in the case of magnetizing the superconductor used in the instrument as a magnet by means of the prior art magnetizing device. It is necessary, however, to maintain the superconductor at the temperature when magnetized or below in order to keep the trapped magnetic field thereof. Once the superconductor reaches higher temperatures than its superconducting transition temperature, its magnetization is completely demagnetized. As a result, since it is necessary to keep the internal portion of the instrument within a refrigerant, it will be very difficult to incorporate the superconductor magnetized at the outside of the instrument into the internal portion of the instrument while keeping the superconductor at the temperatures which could keep its trapped magnetic field as it is.

Then, in order to keep the trapped magnetic field of the superconductor incorporated into the instrument, it is also necessary to keep the superconductor cool by supplying refrigerant at all the time and it may take very long time whether the instrument may be operated or not.

Furthermore, even though the superconductor may be magnetized once, the resulting magnetic flux thereon creep with time and the trapped magnetic field is weakened. Therefore, for preserving the capacity as a magnet, it is necessary to take out the used superconductor from the instrument after a certain period of time and then magnetize the superconductor again. Carrying out such an operation is very difficult due to the cooling problem described above.

SUMMARY OF THE INVENTION

Now, the present inventors have turned their technical idea of the invention at another angle, that is, they have given their attention to the first technical idea of the invention that a magnetizing coil is provided between a superconductor and a refrigerant container and at the same time, they have also given their attention to the second technical idea of the invention that the superconductor is pulse magnetized by flowing a pulse current in the magnetizing coil, resulting in accomplishing the present invention.

In the prior art, it has been considered that a large-sized magnetizing device C with a large capacity having the magnetizing coil cooled by the water is required for magnetizing superconductor, and as shown in FIG. 5, it has been also considered that the magnetizing device C is provided at the outside of a refrigerant container R in which a superconductor S is installed to the internal portion thereof. As the refrigerant container R was intervened between the superconductor S and the magnetizing device C, the resulting distance between them becomes larger and a larger magnetizing device C was furthermore required. Therefore, it was impossible to arrange a superconductor magnet device and a magnetizing device for superconductor within an instrument in part. As described above, in the case of the superconductor was used in the instrument as the magnet, the superconductor was preliminarily magnetized by means of the large-sized magnetizing device, and then, it was placed within the refrigerant container in the instrument. It could not be practically used.

It is a general object of the present invention to provide a miniature superconducting magnet device and a magnetizing device for superconductor by providing a magnetizing coil within the refrigerant container to be placed with the superconductor and shortening the distance between the magnetizing coil and the superconductor.

It is a more specific object of the present invention to more miniaturize the magnetizing coil described above, for providing a more practical superconducting magnet device and a magnetizing device for superconductor by means of flowing a pulse current in the magnetizing coil of the superconductor. It has never carried out in the prior art that the means of flowing the pulse current flows the pulse current in the magnetizing coil of the superconductor in the superconducting magnet device and the magnetizing device for superconductor, since the device of the present invention, in which the superconductor is magnetized in a direction of disturbing the change of the applied magnetic field in the superconductor, is different from a ferromagnetic substance like a permanent magnet which is magnetized in the same direction as the applied magnetic field.

It is another object of this invention to provide a miniaturized superconducting magnet device and magnetizing device.

It is still another object to make it possible to place a superconductor in the internal portion of an instrument integrated with the superconductor in order to arrange the superconductor in an arbitrary position in the internal portion of the instrument and permanently or occasionally use it as a magnet.

It is a further object of the invention to make it possible to magnetize under the condition that the joule heat of a coil is less.

It is a still further object of the invention to make it possible to flow a large current into the coil so as to magnetize it.

It is another object of the invention to make it possible to freely carry out the magnetization or demagnetization of superconductor.

It is a still another object of the invention to make it possible to magnetize a superconductor described above under the condition that the superconductor and the magnetizing device are incorporated into an applied instrument.

It is a further object of the invention to make it possible to separate a power source from the magnetizing device and its applied instrument.

A still further object of the invention is to make it possible to generate a large magnetic field and magnetize a superconductor requiring a large applied magnetic field.

Another object of this invention is to make it possible to magnetize a magnetic material having a large coercive force only at low temperatures.

Yet another object of this invention is to provide a superconducting magnet device comprising: a refrigerant container controlled at a superconducting transition temperature or below; a superconductor provided in the refrigerant container; a coil provided around the superconductor in the refrigerant container.

A further object of this invention is to provide a magnetizing device for superconductor comprising: a refrigerant container controlled at a superconducting transition temperature or below; a superconductor provided in the refrigerant container; a coil provided around the superconductor in the refrigerant container; a power source for generating a current to be supplied to the coil; and a current supply line for supplying the current generated from the power source to the coil.

A still further object of this invention is to provide a magnetizing device for superconductor having a power source comprising the pulse power source for generating pulse current, and the refrigerant container accommodating the refrigerant at the temperature of a superconducting transition temperature or below.

Another object of this invention is to provide a magnetizing device for superconductor for arranging the current supply line in the refrigerant pipes of the refrigerant container.

Yet another object of this invention is to provide a magnetizing method for superconductor comprising: cooling the interior of the refrigerant container being provided with a superconductor and a coil and accommodating the refrigerant down to a superconducting transition temperature or below; supplying a current from a power source to the coil so as to allow the coil to generate a magnetic field; and magnetizing the superconductor under the magnetic field formed by the coil.

A further object of this invention is to provide a magnetizing method for superconductor in which the power source supplies a pulse current to the coil and the coil generates a pulse magnetic field.

A still further object of this invention is to provide an applied instrument for superconductor having a portion wherein a refrigerant container inserted with a coil surrounding the superconductor is provided and taking advantage of the characteristics of the superconductor.

Another object of this invention is to provide an applied instrument for superconductor having a portion wherein a refrigerant container inserted with a magnetizing coil surrounding the superconductor is provided together with a vacuum container and taking advantage of the function as a superconducting magnet of the superconductor.

A magnetizing device for superconductor of this invention comprises a coil provided around a superconductor, a current supply line for supplying a pulse current from a power source to the coil, and a refrigerant container for accommodating a refrigerant at a superconducting transition temperature or below, wherein the coil is provided in the refrigerant container.

Further to the above constitution, a magnetizing device for superconductor of this invention can be added with an additional constitution that the current supply line is provided in a refrigerant pipe communicating with the refrigerant container.

According to the above constitution, the overall operation of this invention is as follows:

In the case of providing the above coil in the refrigerant container for accommodating a refrigerant having a superconducting transition temperature or below, the resistance value of the coil is far smaller than that at a room temperature. Therefore the temperature increase of the coil resulting from the joule heat is depressed. Since the coil is cooled down to the superconducting transition temperature or below, the temperature difference between the temperature of the coil when initially energized and the melting point (the temperature for the coil to be fused at) of the coil material can be secured more sufficiently than at the room temperature. Since joule heat is less and the temperature difference between the temperature of the coil when initially energized and the melting point of the coil material can adequately be secured, the instantaneous maximum value of the current for allowed to be flown in the coil without melting the coil is increased. From the above description, the coil cross section and the number of turns of the coil required for obtaining the applied magnetic field as a target are made less and the coil can be miniaturized. On the other hand, in the case of no changing the cross-sectional area of the coil and the numbers of turns thereof, the resulting power capacity can be made smaller.

In the case of flowing a pulse current in the coil, the energized time is short and the heating time for the coil is instantaneous. Unless the temperature of the coil can reach the melting point of the coil material by this instantaneous joule heat, the coil will be free from melting. Therefore, the energized time for the pulse current, the specific heat and melting point of the coil material, and the coil temperature at initial energized time are all important factors for determining the possible current values allowed to be flown in the coil without fusing the coil, while the capacity of the cooling system for the coil has almost nothing to do with this. In other words, the coil used in pulse magnetization does not require such a large cooling mechanism as cools the coil used in a normal conducting electromagnet with high magnetic field. As a result, the coil can be miniaturized. On the other hand, in the case of flowing a pulse current, the instantaneous temperature increase is permissible as far as the coil temperature does not reach the melting point of the coil material. It is possible, even though it is instantaneous, to flow a large current in the coil in comparison with that in the case of flowing a steady-state current where no increase in the coil temperature is permissible. Ultimately, the applied magnetic field required for the magnetization of superconductor can be obtained by means of far smaller coils than the prior art electromagnets because a large current can be flown in the coil by employing a pulse current.

According to the above description, as the coil is miniaturized, the magnet function constituting the superconductor can be accommodated in the instrument compactly and the arrangement thereof can be set freely in the internal portion of the instrument. In this invention the magnetizing device can be set up within the instrument. Therefore, it can be freely done to demagnetize by removing the refrigerant and then magnetize again. Even when the trapped magnetic field of superconductor is lowered by magnetic flux relaxation, further remagnetization is possible when necessary.

In accordance with the invention having the additional constitution described above, the current supply line gets to a temperature roughly equal to that of the refrigerant having the superconducting transition temperature or below and the resulting resistance is decreased, by providing the current supply line in the refrigerant pipes. As a result, it becomes possible to thin the current supply line and the degree of freedom in the arrangement of superconductor within the instrument is increased.

In accordance with the invention, as described above, the overall device is miniaturized and incorporated within an applied instrument by miniaturizing the coil. As a result, it becomes possible to magnetize the superconductor under the condition that the overall device is incorporated within the applied instrument.

DETAILED DESCRIPTION OF PREFERRED EMBODIMENTS

Figure 1:
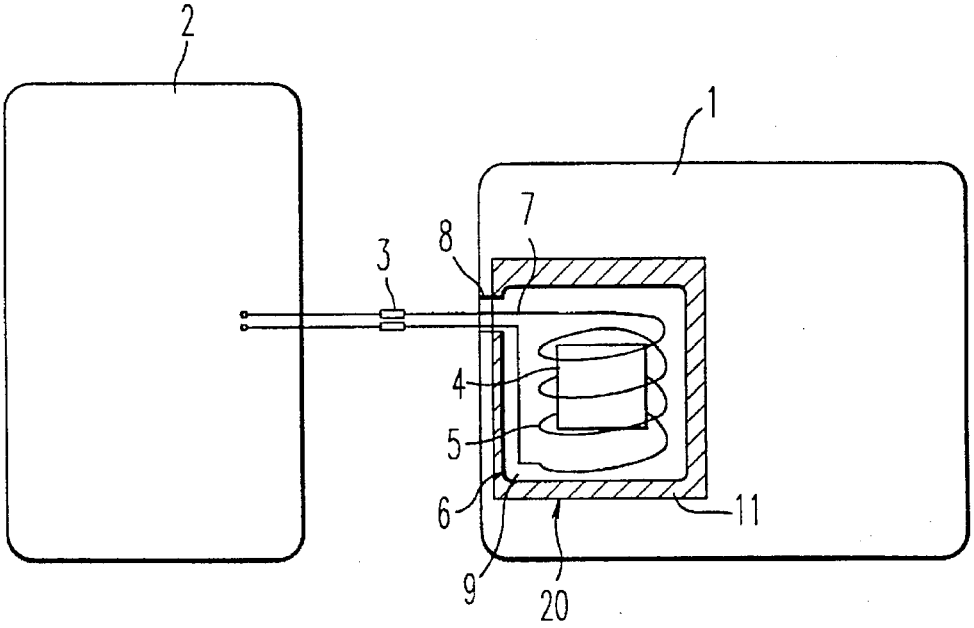
FIG. 1 is a schematic diagram showing a magnetizing device as a preferred embodiment of the present invention.

Referring now to the drawings, the detailed description of the preferred embodiment of the invention will be given in the following.

Figure 2:
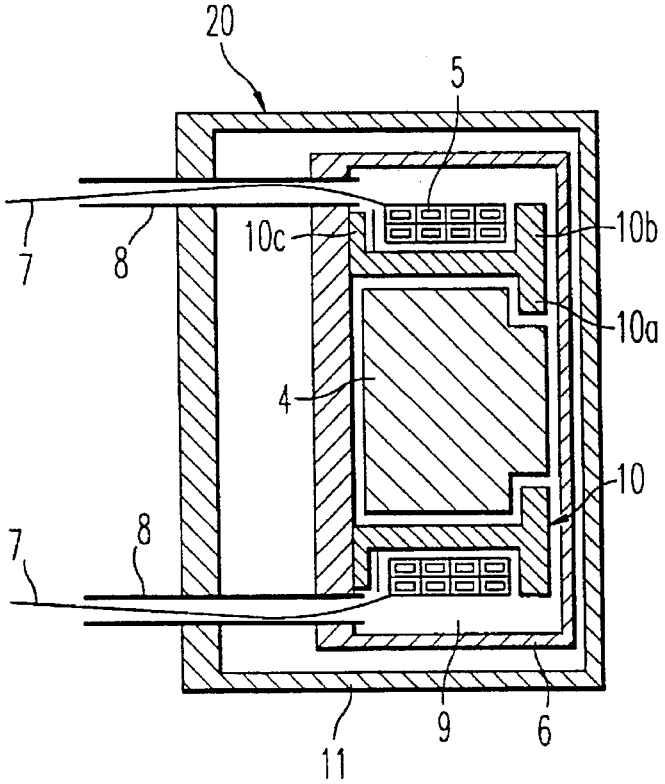
FIG. 2 is a main sectional view showing a magnetizing device as a preferred embodiment of the present invention.

FIG. 1 is a schematic diagram showing a superconducting magnet device and magnetizing device in the preferred embodiment of the invention, a pulse power source and an instrument for accommodating the magnetizing device, as a preferred embodiment of the invention. FIG. 2 is a sectional view showing a magnetizing device as a preferred embodiment of the invention. As shown in FIG. 1, a magnetizing device 20 in the preferred embodiment is provided within an instrument 1 in which a superconductor is used as a magnet. Within the magnetizing device 20, a superconductor 4 is provided and for this superconductor, a bulk body is used which has a microstructure containing fine particles of $Y_2BaCuO_5$ in a large grain of $YBa_2Cu_3O_7$ prepared particularly by a melt-processing method in the present preferred embodiment.

Namely, in this preferred embodiments, the bulk body was made as follows. The calcined powder of $YBa_2Cu_3O_7$ and $Y_2BaCuO_5$ were well mixed and pressed into a pellet. Then the pellets were heated to 1040° C. at a heating rate of 100° C./h, and were held for 2 h. After cooling down to 1000° C., they were slowly cooled down to 940° C. at a rate of 1° C./h, with subsequent furnace cooling to the room temperature. The post annealing was added at 400°–600° C. for 20–60 h for oxygen uptake. All heat treatments were performed in oxygen flowing atmosphere at an ambient pressure.

As shown in FIG. 2, bobbin 10 is provided around the superconductor 4 and the bobbin 10 is wound with magnetizing coil 5. The coil 5 is held by means of projection portions 10*b* and 10*c* of the bobbin 10 not so as to be shifted in a left or right direction in FIG. 2. The magnetizing coil 5 is prepared by doubly winding insulating and covered rectangular wire in cross section, which wire are spaced by an insulating material being impregnated with a resin, and adhered to the bobbin 10. As shown in FIG. 2, the superconductor 4 may also be held at a concave portion provided at the end thereof in the axial direction by means of a projection portion 10*a* from the bobbin 10 not so as to be shifted in a left or right direction in FIG. 2. In this devised manner, the magnetizing coil 5 and the superconductor 4 are prevented from being deformed by a force received from the magnetic force when magnetized. As shown in FIG. 2, an axial end convex portion of the superconductor comes close to the wall of the refrigerant container.

The superconductor 4, magnetizing coil and the bobbin 10 are arranged within a refrigerant container 6 for accommodating a liquid nitrogen 9 of 77K so as to be cooled down to 77K. A vacuum container 11 is further provided around this refrigerant container 6 so as to prevent the invasion of heat from the outside, and the internal portion of the vacuum container 11 remains in a vacuum state. As shown in FIG. 2, the vacuum container 11 has a wall opposed to the wall of said refrigerant container 6. A pair of refrigerant pipes 8 communicate with the refrigerant container 6, and the liquid nitrogen 9 is arranged to be filled into the refrigerant pipes 8. A current supply line 7 are provided in the refrigerant pipes and cooled so as to be kept at 77K. This current supply line 7 is connected to the magnetizing coil 5 and a pulse power source (power source) 2. Incidentally, as shown in FIG. 1, a terminal 3 is provided on the way of the current supply line and the instrument 1 and the pulse power source are thereby arranged to be separable.

Now, the detailed description of a magnetizing method for superconductor 4 will be given in the following.

The superconductor 4 is preliminarily cooled down to the superconducting transition temperature or below in the refrigerant container 6 in which the liquid nitrogen 9 is accommodated. Under this condition, a pulse magnetic field is generated in the magnetizing coil 5 by a pulse current supplied from the pulse power source 2. Then, the magnetic field is applied on the superconductor 4 resulting in magnetizing the superconductor 4. Incidentally, the pulse power source 2 is used only for magnetization and after magnetization the superconductor 4 functions as a magnet regardless of the pulse current. Therefore, the instrument 1 can freely be transferred independently of the grounding positions of the pulse power source 2 when no further magnetization is required to the superconductor for the time being.

Figure 3:
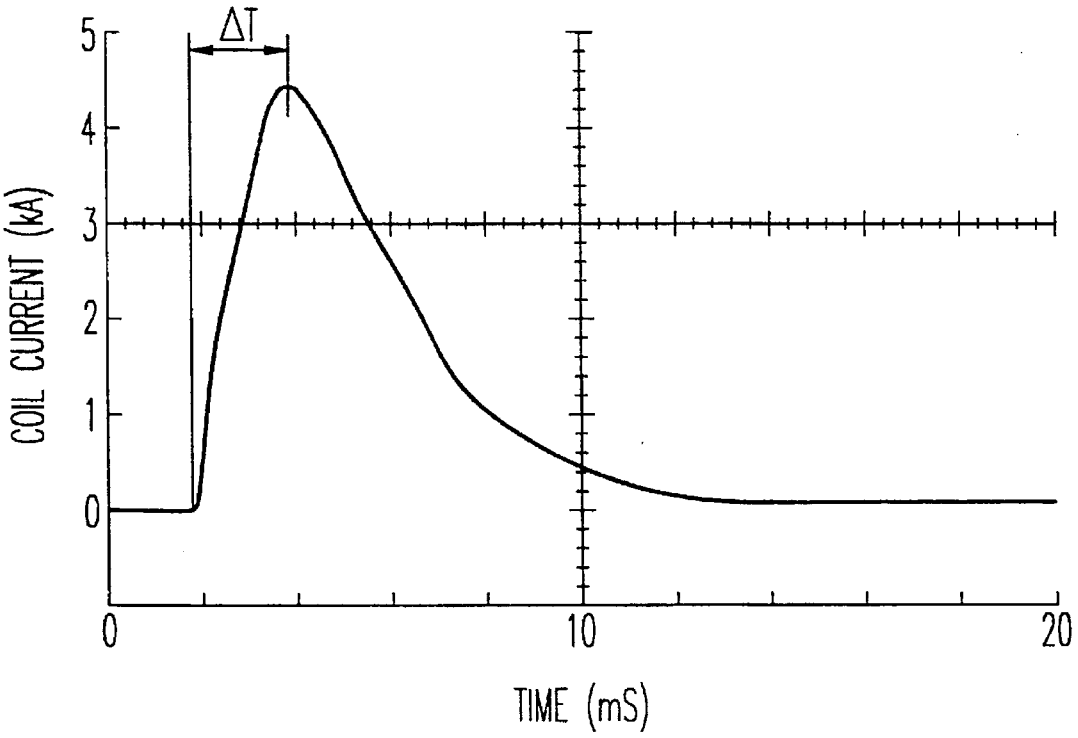
FIG. 3 is a graph showing a current waveform when a pulse current flows in the coil according to the present invention.

FIG. 3 is a graph showing a current waveform flowing in the coil 5 in the case when a pulse current flows in this magnetizing device 20. This is obtained from measuring the voltage between the both ends of the shunt resistor connected to the magnetizing coil 5 in series by a digital storage oscilloscope. The pulse current used here employs the discharge from a condenser. The charging voltage of the condenser is 400 V, the rise time of the pulse current is 2.32 ms, the maximum current value is 4240 A, and the maximum generated magnetic field of the magnetizing coil at this time is 46.6 kOe. In the magnetizing device 20 of this embodiment, the maximum generated magnetic field of the magnetizing coil 5 can be up to 80 kOe.

In the magnetizing device 20 of this preferred embodiment, the magnetizing coil 5 is provided in the liquid nitrogen 9. Therefore, it is to be readily understood that a large pulse current can be flown in the magnetizing coil 5 easily and in spite of the simple and miniature device, a large magnetic field can be generated.

Figure 4:
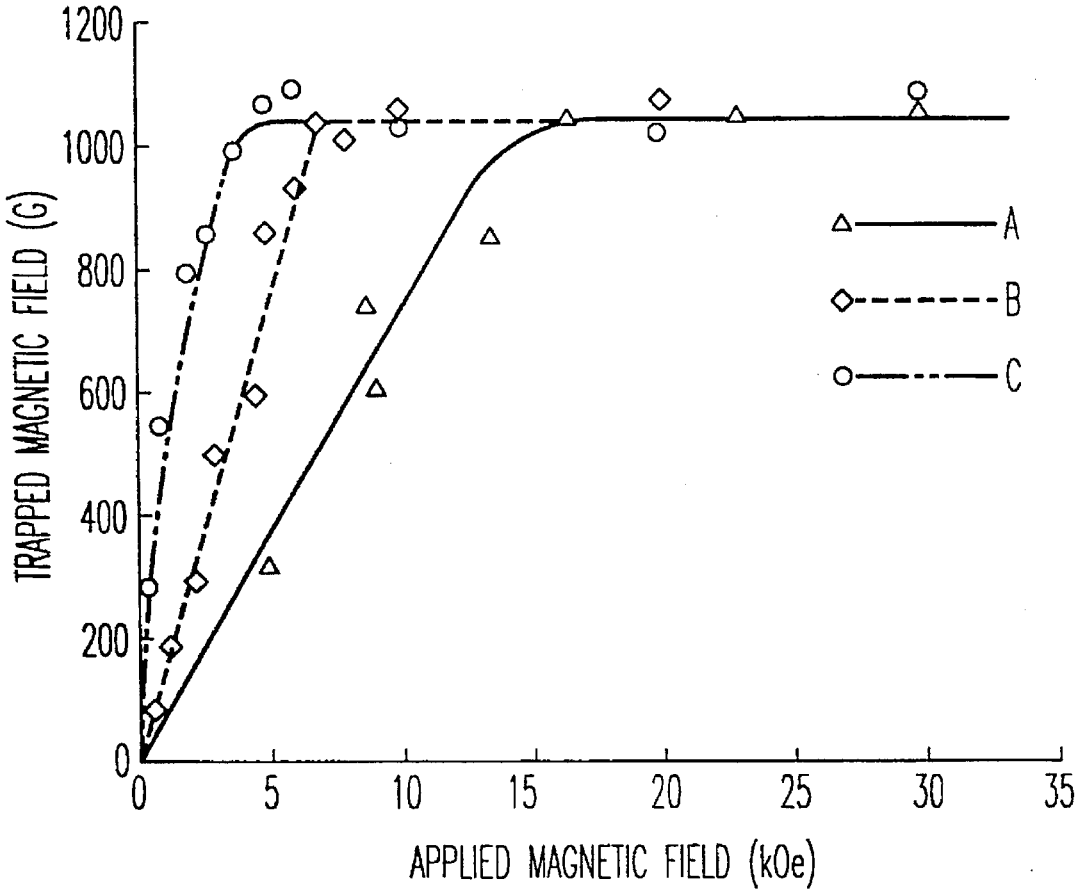
FIG. 4 is a graph showing a relation between the applied magnetic field and the trapped magnetic field of a superconductor in the case of magnetizing a preferred embodiment superconductor using a magnetizing device of the present invention and a prior art magnetizing apparatus.
Figure 5:
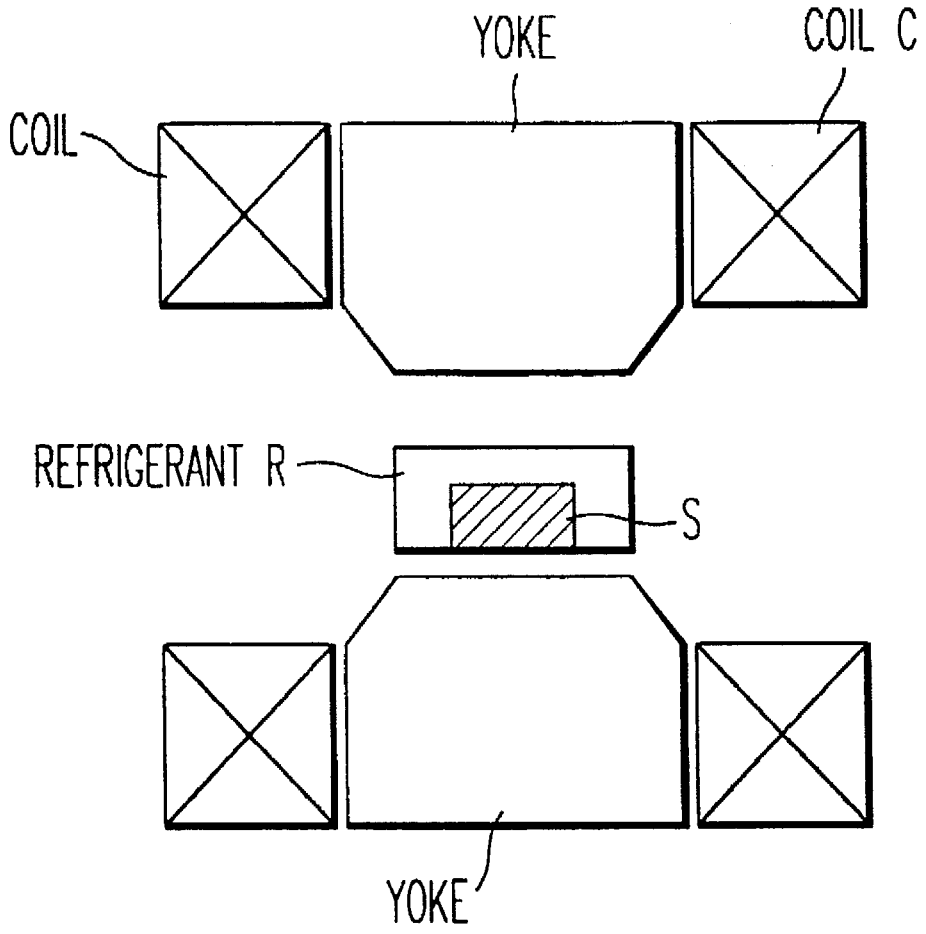
FIG. 5 PRIOR ART
FIG. 5 is a sectional view showing a magnetizing device as a prior art.

FIG. 4 is a graph showing a relation between the applied magnetic field and the trapped magnetic field of a superconductor in the following cases wherein: (A) the magnetizing device 20 in this preferred embodiment is used, (B) a normal conducting electromagnet of the prior art is used in FC, and (C) a normal conducting electromagnet is used in ZFC, respectively.

As apparent from FIG. 4, it can be confirmed that the superconductor 4 is firmly magnetized by the pulse magnetic field generated for such a short time as used in this preferred embodiment. In other words, it can be understood that such a large pulse magnetic field generated by this miniature and simple magnetizing device 20 of this preferred embodiment can be employed as an applied magnetic field for magnetizing the superconductor 4. In the case of the power source 2, the magnetizing coil 5 and the superconductor 4 used in this preferred embodiment, the maximum generated magnetic field required for obtaining the same trapped magnetic field under the pulse magnetization (A) was four times larger than that of the applied magnetic field required to the case of magnetizing under the steady-state current flow FC (B). When the superconductor 4 is magnetized in FC under the substantially large applied magnetic field, the resulting trapped magnetic field is maximized. However, the maximum trapped magnetic field of the superconductor 4 used in this preferred embodiment is approximately 1000 G in the case of B. The superconductor 4 could be magnetized up to the maximum trapped magnetic field of the superconductor 4 by applying a substantially large magnetic field thereon even though a pulse magnetization might be used. Furthermore, the trapped magnetic field of the superconductor 4 can be adjusted arbitrarily within the range up to the maximum trapped magnetic field by adjusting the applied magnetic field. In this manner, the superconductor 4 can be used as a magnet having any given magnetic force within the range up to the maximum trapped magnetic field in the case of this preferred embodiment in which the magnetizing coil 5 with the superconductor 4 is provided in the refrigerant container 6 and the superconductor 4 is magnetized by the pulse magnetic field.

As described above, it has been verified in this preferred embodiment that the pulse magnetization is useful when the superconductor 4 is magnetized. Since the magnetizing coil 5 is provided within the refrigerant container 6 in which the liquid nitrogen 9 is accommodated, the magnetizing coil 5 is miniaturized, and the overall body of the magnetizing device 20 is accordingly miniaturized. As a result, the whole body of the device 20 can be incorporated within the instrument 1. Thus, it becomes possible to magnetize the superconductor 4 under the condition that the device 20 is incorporated within the instrument. Thereby, there was a disadvantage in the case when the prior art superconductor is used as a magnet, but now, there is no need of a process for incorporating the magnetized superconductor within the instrument and the superconductor 4 can easily be employed as a magnet within the instrument.

Since the superconductor 4 integrated with the magnetizing device 20 can be accommodated in the instrument 1 in a compact manner, it is also possible to arrange the superconductor 4 in the internal portion of the instrument 1 freely. In this manner, in the case of incorporating the magnetizing device 20 within the instrument 1, it can be freely done to remove the refrigerant to demagnetize and then, further remagnetize when necessary. Even when the trapped magnetic field of the superconductor is lowered by magnetic flux relaxation, further remagnetization is possible when necessary.

Since the terminal 3 is installed to the current supply line 7, the instrument 1 is separable from the pulse power source 2 so as to allow the instrument 1 to be freely transferred independently of the ground place of the pulse power source 2.

In addition to the above effects of this preferred embodiment, since the magnetizing coil 5 is cooled by the liquid nitrogen 9, it is possible to flow a large current in the magnetizing coil 5, generate a large magnetic field with ease and magnetize such a superconductor as requires a large applied magnetic field.

Furthermore, although the magnetizing device 20 of the invention has been disclosed and described, it is not limited to only the magnetization of the material as a superconductor described in the preferred embodiments. The magnetizing device 20 can be applied to all of the superconductor having their pinning points of magnetic flux. It is also possible to apply the magnetizing device of the invention to the magnetization of the magnetic material having a large coercive force only at low temperatures. It is to be understood that there are no restrictions of the pulse power source for magnetization, coil shape, etc., in the disclosed embodiments and that other forms might be replaced therewith.

As a pulse power source, in addition to the charging type in which chemical condenser are used, as explained in the above preferred embodiment, the charging type in which oil condensers are used, and a silicon type in which a pulse current is obtained by short-circuiting a rectified current of an AC source, can be utilized as well.

Now, it is preferable that the superconductor described above is of a bulk type (fillet-shaped). As a material for it, one example has already been explained in the preferred embodiment described above. However, the following examples may be also preferable e.g., Y-Ba-Cu-O, Ba-(Pb)-Sr-Ca-Cu-O, Tl-Ba-Ca-Cu-O, Hg-Ba-Ca-Cu-O.

It is preferable that the superconductor is prepared particularly by a melt-processing method.

Then, in addition to the liquid nitrogen explained in the preferred embodiment described above, the preferable refrigerant can be a liquid refrigerant selected from any one of liquid argon, liquid air, liquid oxygen, liquid methane and liquid krypton. The above listed substances have their boiling points 77K, 87K, 79K, 90K, 121K and 120K at 1 atmospheric pressure, respectively. That is, these boiling points are sufficiently high temperatures in comparison with the boiling point of liquid helium 4K. Thus, there is an advantage that no particular heat insulating mechanism is needed for the refrigerant container and the refrigerant pipes. In addition to this, there is another advantage that liquid nitrogen and liquid air are inexpensive.

Further, the refrigerant described above may be any substances adaptable so far as the boiling point thereof is higher than that of liquid helium and lower than the critical temperature of the superconductor used as a magnet, and that the heat of vaporization thereof is larger than that of liquid helium.

It is also possible to control the temperature of the refrigerant at its boiling point or below by reducing a vapor pressure of liquid refrigerant within the refrigerant container and the refrigerant pipes to lower the refrigerant temperature.

It is also possible to decrease the temperature of the refrigerant to the triple point where solid phase, liquid phase and gas phase coexist by reducing the pressure thereof. In other words, liquid nitrogen, liquid argon, liquid oxygen, liquid methane and liquid krypton can be used as a liquid refrigerant down to the temperatures 63K, 84K, 54K, 91K, and 116K respectively.

As a refrigerant, it is possible to employ a gaseous refrigerant selected from the group of cooled helium gas, hydrogen gas and neon gas. The gaseous refrigerant described above can be charged in the refrigerant container by using a small quantity of it, in comparison with the quantity of the liquid refrigerants. As the gas has a low viscosity, the diameter of the pipe for circulating the refrigerant can be made smaller, resulting in reducing the inside space thereof and lightening the weight in comparison with the liquid refrigerant. The above helium gas cannot be easily liquefied and it is excellent as a gaseous refrigerant.

Now, the above gaseous refrigerant is cooled by means of a freezer and preferably circulated between the freezer and the refrigerant container described above. This is done for preventing the increase in temperature of the gaseous refrigerant. Thus, the superconductor can be always kept at a constant temperature.

Then, the refrigerant described above is preferably provided within a vacuum container. In this manner, the heat insulation of the refrigerant container is improved much more.

In the present invention the number and disposition of the magnetizing device is not limited by the above preferred embodiment. In the present invention it is possible to modify the number and disposition of the magnetizing device in accordance with the need.

What is claimed:

1. A superconducting magnet device comprising:

a refrigerant container, controlled at a superconducting transition temperature or below, and having a wall;

a superconductor, provided within said refrigerant container adjacent to said wall of said refrigerant container and arranged such that it applies a magnetic force external to said device; and a coil provided within said refrigerant container, and wound around said superconductor.

2. A magnetizing device for a superconductor comprising:

a refrigerant container, controlled at a superconducting transition temperature or below, and having a wall;

a superconductor composed of a bulk body having a microstructure wherein smaller particles are contained in a larger grain of oxide superconducting material provided within said refrigerant container adjacent to said wall of said refrigerant container and arranged such that it applies a magnetic force external to said device;

a coil provided within said refrigerant container, and wound around said superconductor;

a pulse power source for generating a pulse current to be flown in said coil; and a current supply line for supplying the current generated from said power source to said coil, said current supply line being connected to said power source and coil.

3. A magnetizing device for superconductor according to claim 2, wherein said refrigerant container accommodates a refrigerant below a superconducting transition temperature.

4. A magnetizing device for superconductor according to claim 3, wherein said refrigerant container accommodates a refrigerant selected from the group consisting of liquid nitrogen, liquid argon, liquid air, liquid oxygen, liquid methane, liquid krypton, cooled helium gas, hydrogen gas, and neon gas.

5. A magnetizing device for superconductor according to claim 3, wherein said refrigerant container has refrigerant pipes for supplying the refrigerant and is provided within a vacuum container having a wall opposed to said wall of said refrigerant container maintained in a vacuum state so as to shield the heat from the outside thereof.

6. A magnetizing device for superconductor according to claim 3, wherein said superconductor is composed of a bulk body consisting of a microstructure containing fine particles of oxide superconductive material in a large grain.

7. A magnetizing device for superconductor according to claim 6, wherein said fine particles are $Y_2BaCuO_5$, and said large grain is $YBa_2Cu_3O_7$.

8. A magnetizing device for superconductor according to claim 3 wherein said superconductor is one selected from the group consisting of Y-Ba-Cu-O, Ba-(Pb)-Sr-Ca-Cu-O, Tl-Ba-Ca-Cu-O, and Hg-Ba-Ca-Cu-O.

9. A magnetizing device for superconductor according to claim 8, wherein said coil comprises a magnetizing coil comprising a wire of a rectangular cross section covered by an insulating material and being doubly wound around a bobbin provided around said superconductor, and wherein insulating material is interposed between said doubly wound magnetizing coil.

10. A magnetizing device for superconductor according to claim 9, wherein said superconductor has a convex portion at the end thereof in the axial direction in order to come closer to said wall of said refrigerant container.

11. A magnetizing device for superconductor according to claim 9, wherein said bobbin wound with said magnetizing coil has a flange portion and is engaged in a concave portion formed in said superconductor.

12. A magnetizing device for superconductor according to claim 3, wherein said current supply line is provided within the refrigerant pipes connected with said refrigerant container.

13. A magnetizing device for superconductor according to claim 12, wherein said current supply line has a terminal for connecting or disconnecting said coil and said pulse power source.

14. A magnetizing device for superconductor according to claim 6, wherein said pulse power source comprises a chemical condenser power source using the discharge characteristics thereof, and generates a pulse current having a pulse risetime of m sec order.

15. A magnetizing device for superconductor according to claim 3, wherein said pulse power source comprises a silicon power source for rectifying the half wave of AC.

16. A magnetizing device for superconductor according to claim 3, wherein said pulse power source comprises an oil condenser type power source using the discharge characteristics thereof.

17. An applied instrument for superconductor comprising:

a superconducting magnet device comprising a refrigerant container, controlled at a superconducting transition temperature or below, and having a wall, a superconductor, provided within said refrigerant container, and having an output portion for applying a magnetic field provided adjacent to said wall of said refrigerant container;

a coil provided within said refrigerant container, and wound around said superconductor; and an applying device for utilizing the magnetic field applied from said superconductor in said magnetizing device.

18. An applied instrument for superconductor according to claim 7, further comprising:

a power source for generating a current to be flown in said coil; and a current supply line for supplying the current generated from said power source to said coil, said current supply line being connected to said power source and coil.

19. An applied instrument for superconductor according to claim 17, wherein said refrigerant container is provided within a vacuum container.

20. A superconducting magnet device according to claim 1, wherein said superconductor is made by a melt-processing method.

21. A magnetizing device for superconductor according to claim 4, further comprising a circulating device, for circulating the gaseous refrigerant, connected to said refrigerant container and a freezer in order to prevent the increase in temperature of the gaseous refrigerant.

22. The superconducting magnet device of claim 1, wherein said refrigerant container contains a refrigerant, and wherein said superconductor is contained within said refrigerant.

23. The magnetizing device of claim 2, wherein said refrigerant container contains a refrigerant, and wherein said superconductor is contained within said refrigerant.

24. An applied instrument as claimed in claim 17, wherein said refrigerant container contains a refrigerant, and wherein said superconductor is contained within said refrigerant.

25. The superconducting magnet device as claimed in claim 1, wherein said superconductor has a trapped magnetic field and wherein the magnetic force applied by the superconductor external to said device is equal to the trapped magnetic field.

26. A magnetizing device as claimed in claim 2, wherein said superconductor has a trapped magnetic field and wherein the magnetic force applied by said superconductor external to said device is equal to said trapped magnetic field.

27. The magnetizing device as claimed in claim 2, wherein said superconductor is made by melt-processing method.

28. The superconducting magnet device as claimed in claim 1, wherein said superconductor consists of smaller particles of $Y_2BaCuO_5$ in a large grain of $YBa_2Cu_3O_7$.

* * * * *